US011525281B1

(12) United States Patent
Tsai et al.

(10) Patent No.: US 11,525,281 B1
(45) Date of Patent: Dec. 13, 2022

(54) SMART DOOR LOCK DEVICE

(71) Applicant: Primax Electronics Ltd., Taipei (TW)

(72) Inventors: Yung-Ming Tsai, Taipei (TW); Li-Kuei Cheng, Taipei (TW); Chi-Hsiang Sun, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/845,618

(22) Filed: Jun. 21, 2022

(30) Foreign Application Priority Data

May 11, 2022 (TW) ..... 111117699

(51) Int. Cl.
*E05B 17/10* (2006.01)
*E05B 17/22* (2006.01)

(52) U.S. Cl.
CPC ..... *E05B 17/10* (2013.01); *E05B 17/22* (2013.01)

(58) Field of Classification Search
CPC ..... E05B 17/10; E05B 17/22
USPC ..... 362/100
See application file for complete search history.

(56) References Cited

U.S. PATENT DOCUMENTS

| | | | | |
|---|---|---|---|---|
| 3,590,234 | A * | 6/1971 | Bartick | E05B 17/10 362/802 |
| 6,273,579 | B1 * | 8/2001 | Holloway | E05B 17/10 362/100 |
| 6,447,139 | B1 * | 9/2002 | Wilkes | E05B 17/10 362/802 |
| 6,461,013 | B1 * | 10/2002 | Simon | E05B 17/10 362/276 |
| 6,932,486 | B1 * | 8/2005 | Eller | E05B 15/02 362/100 |
| 2006/0144103 | A1 * | 7/2006 | Blanch | E05B 41/00 70/330 |
| 2006/0203471 | A1 * | 9/2006 | Hodges | E05B 17/10 362/802 |
| 2010/0295484 | A1 * | 11/2010 | Smith | E05B 17/10 315/362 |
| 2015/0308153 | A1 * | 10/2015 | Guarascio | E05B 17/10 362/100 |

* cited by examiner

*Primary Examiner* — Laura K Tso
(74) *Attorney, Agent, or Firm* — Kirton McConkie; Evan R. Witt

(57) ABSTRACT

A smart door lock device is installed on a door panel. The smart door lock device includes a base, a handle and a projection module. The base is combined with the door panel. The handle is installed on the base. The projection module is installed on the base. A safe door opening range image corresponding to a rotation range of the door panel can be projected on a ground by the projection module.

6 Claims, 7 Drawing Sheets

SMART DOOR LOCK DEVICE

FIELD OF THE INVENTION

The present invention relates to a door lock device, and more particularly to a door lock device with a warning function.

BACKGROUND OF THE INVENTION

With the advancement of modern technologies, smart home appliances are gradually and widely used in home lives to make home lives more comfortable and convenient. Briefly speaking, users can control smart home appliances through voice commands or portable electronic devices. Moreover, users can remotely control and operate the smart home appliances through a smart home control system.

A smart door lock system is one of various smart home appliances. Generally, the smart door lock system has the function of identifying biometrics features (e.g., the fingerprint identification function or the facial feature identification function) and has the function of connecting with a security system. However, in order achieve anti-theft and good sound insulation effect, the door panel equipped with the smart door lock is usually very thick and heavy. If the user does not know the rotation range of the door panel when opening the door panel, some problems occur. For example, since the rotation range of the door panel is unknown, the body or limbs of the user are possibly injured because the user is hit by the door panel accidentally.

In order to overcome the drawbacks of the conventional technologies, it is important to provide a smart door lock device with a function of warning a rotation range of a door panel.

SUMMARY OF THE INVENTION

The present invention provides a smart door lock device with a function of warning a rotation range of a door panel.

In accordance with an aspect of the present invention, a smart door lock device is provided. The smart door lock device is installed on a door panel. The smart door lock device includes a base, a handle and a projection module. The base is combined with the door panel. The handle is installed on the base. The projection module includes a lamp holder, a light-emitting unit and an optical cover. The lamp holder is combined with the base. The lamp holder includes a light projection surface. The light projection surface has a mounting hole. The light-emitting unit is disposed within the lamp holder and aligned with the mounting hole. The optical cover is installed in the mounting hole. The light-emitting unit is covered by the optical cover. The optical cover includes at least one light-transmissible part. After the light-emitting unit projects a light beam to the at least one light-transmissible part, the light beam is transmitted through the at least one light-transmissible part. Consequently, a safe door opening range image corresponding to a rotation range of the door panel is formed on a ground.

In an embodiment, each of the at least one light-transmissible part has a shape of a three-quarter circle.

In an embodiment, the light-emitting unit is a light emitting diode unit, an organic light emitting diode unit, a quantum dot light emitting diode unit or an electroluminescent unit.

In an embodiment, the handle is linked with the projection module. When the user touches the handle, the handle drives the light-emitting unit to project the light beam.

In an embodiment, the smart door lock further includes at least one distance sensing unit, and the at least one distance sensing unit is installed on the base and linked with the projection module. When a user approaches the door panel, the distance sensing unit drives the light-emitting unit to project the light beam.

In an embodiment, each of at least one the distance sensing unit is an ultrasonic sensing unit, a laser sensing unit, an infrared sensing unit or an image sensing unit.

From the above descriptions, the present invention provides a smart door lock device. When the user intends to open the door panel, the user can realize the rotation range of the door panel according to the safe door opening range image on the ground. Consequently, the body or limbs of the user will not be injured by the door panel. Moreover, the safe door opening range image can prompt the user of whether there is any obstacle in the rotation range of the door panel. After the obstacle is removed, the door panel can be opened smoothly. In other words, the smart door lock device of the present invention is industrially valuable.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
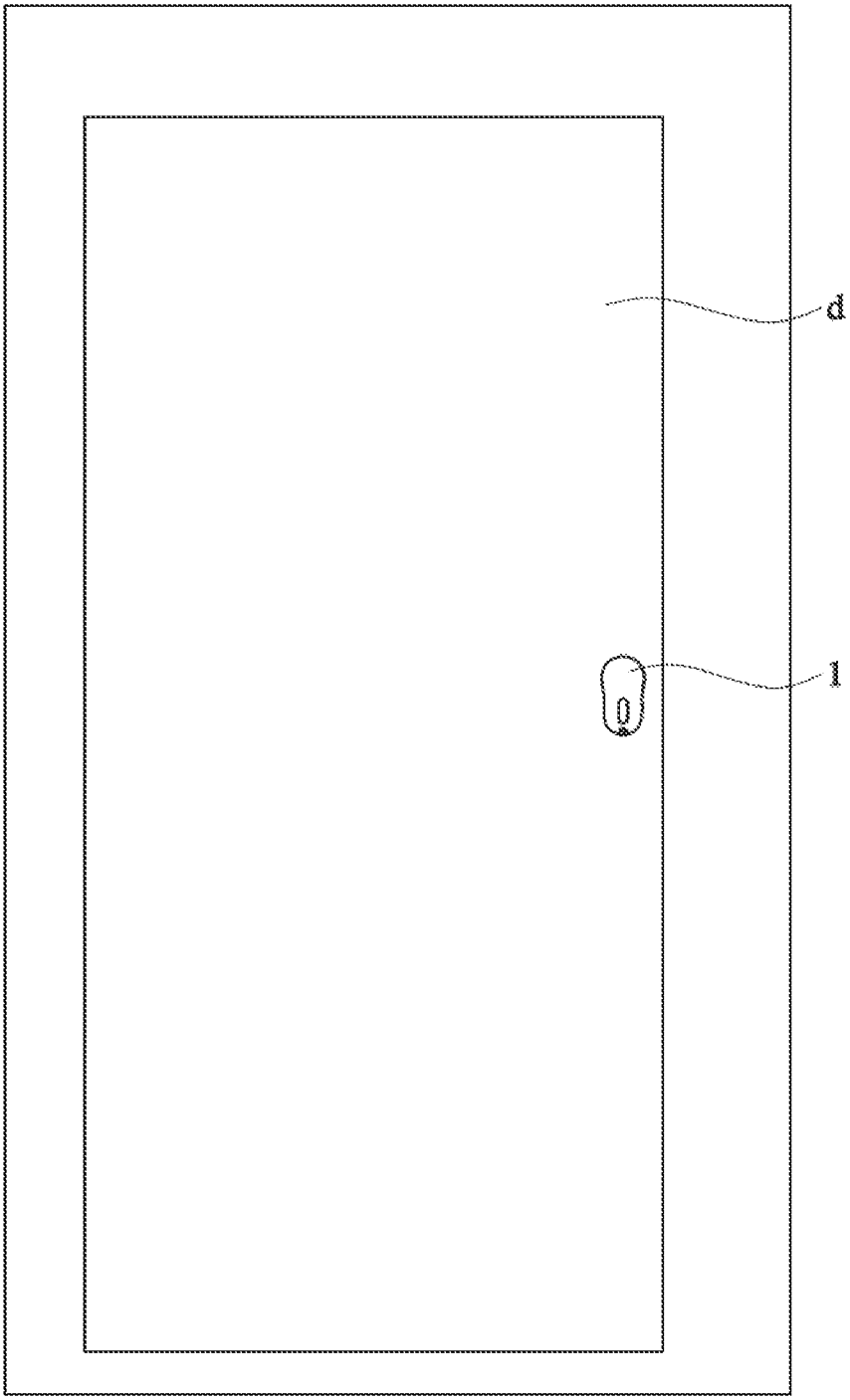
FIG. 1 a schematic front view illustrating a smart door lock device according to a first embodiment of the present invention, in which the smart door lock device is installed on a door panel.

Please refer to FIG. 1. FIG. 1 a schematic front view illustrating a smart door lock device according to a first embodiment of the present invention, in which the smart door lock device is installed on a door panel. In an embodiment, the smart door lock device 1 is installed on a middle region of a right side of a door panel d. A door pivot (not shown) is installed on a left side of the door panel d. After the smart door lock device 1 is unlocked, the user can open the door panel d. While the door panel d is opened and the door panel d is pushed or pulled, the door panel d is swung relative to the door pivot. Consequently, a rotation range corresponding to the width of the door panel d is defined.

Figure 2A:
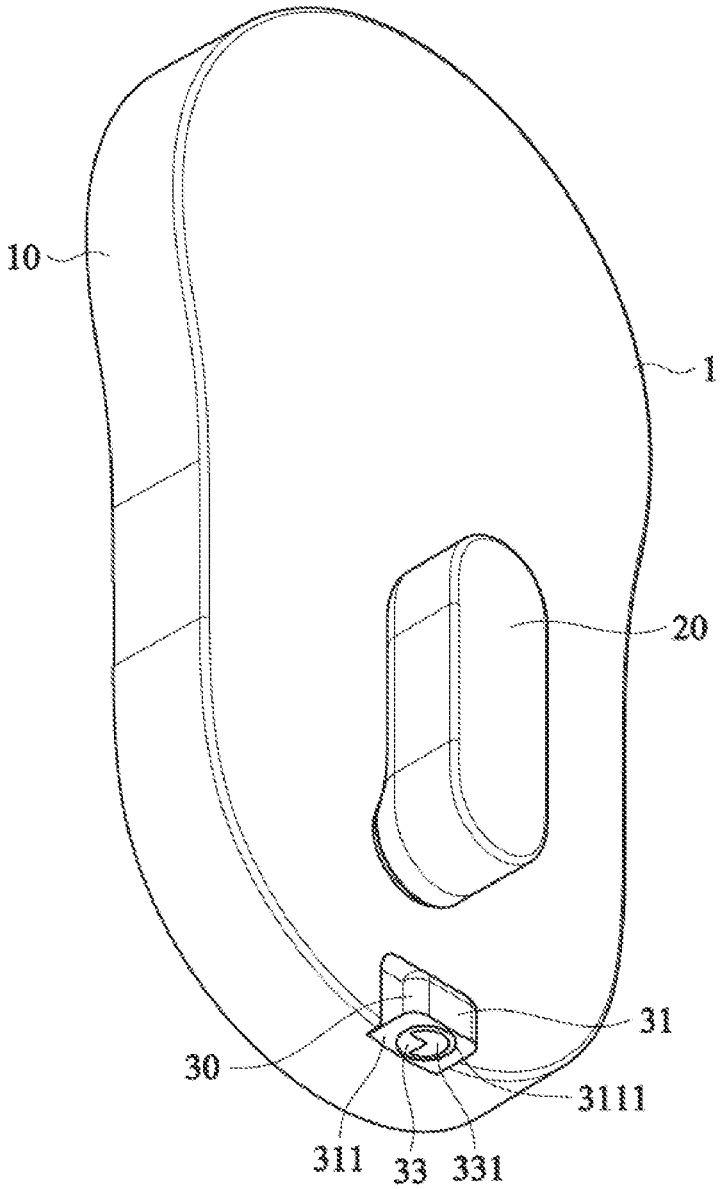
FIGS. 2A and 2B are schematic perspective views illustrating the smart door lock device according to the first embodiment of the present invention.
Figure 2B:
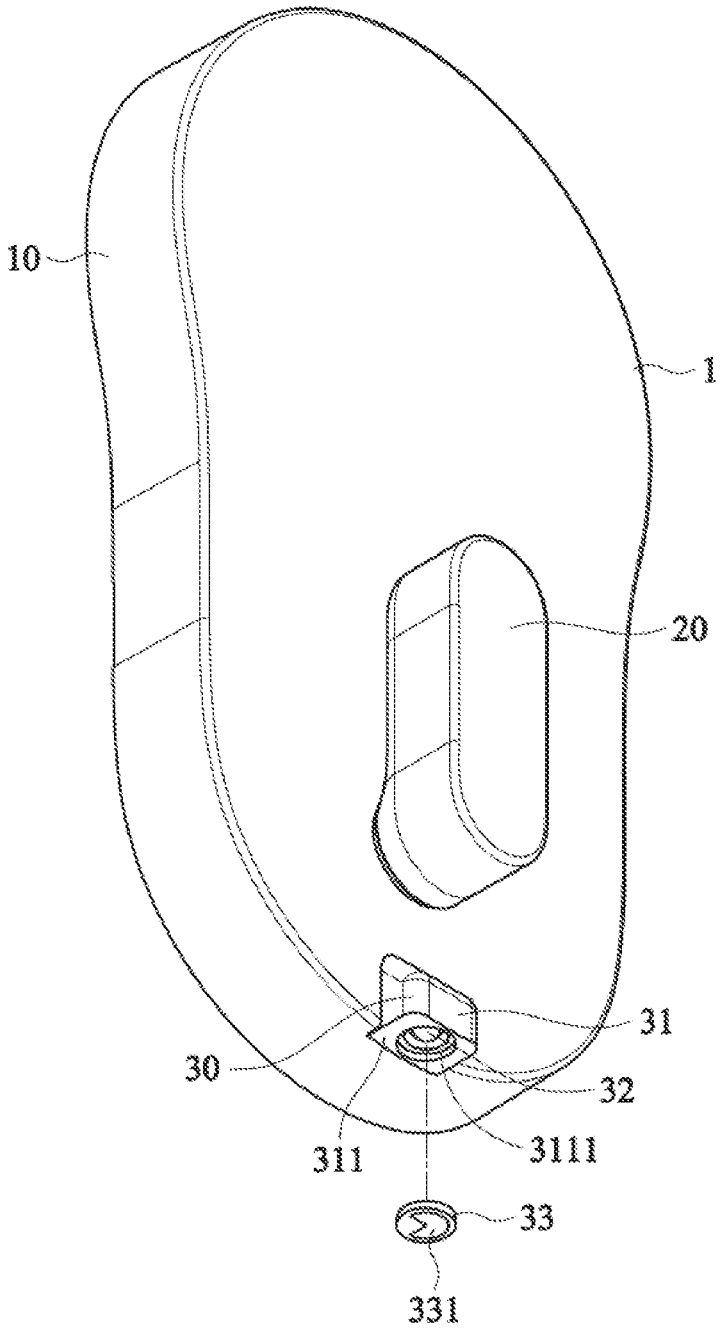

FIGS. 2A and 2B are schematic perspective views illustrating the smart door lock device according to the first embodiment of the present invention. As shown in FIGS. 2A and 2B, the smart door lock device 1 comprises a base 10, a handle 20 and a projection module 30.

The base 10 is combined with the door panel d. A locking mechanism (not shown) is disposed with the base 10.

The handle 20 is installed on the base 10. Moreover, the handle 20 is linked with the locking mechanism.

The projection module 30 comprises a lamp holder 31, a light-emitting unit 32 and an optical cover 33.

The lamp holder 31 is combined with the base 10. The lamp holder 31 comprises a light projection surface 311. Moreover, the light projection surface 311 has a mounting hole 3111. In this embodiment, the projection module 30 is located under the handle 20. It is noted that the installation position of the projection module 30 is not restricted. As long as the projected image from the projection module 30 is not blocked by the handle 20, the projection module 30 can be installed on any position of the base 10.

The light-emitting unit 32 is disposed within the lamp holder 31 and aligned with the mounting hole 3111. For example, the light-emitting unit 32 is a light emitting diode unit, an organic light emitting diode unit, a quantum dot light emitting diode unit or an electroluminescent unit. The optical cover 33 is aligned with the mounting hole 3111. The optical cover 33 is detachably installed in the mounting hole 3111. When the optical cover 33 is installed in the mounting hole 3111, the light-emitting unit 32 is also covered by the optical cover 33. In an embodiment, the optical cover 33 comprises one or plural light-transmissible parts 331. The light-emitting unit 32 is used to project a light beam to the light-transmissible part 331. After the light beam from the light-emitting unit 32 is transmitted through the light-transmissible part 331, a safe door opening range image covering or corresponding to the rotation range of the door panel d is formed on the ground.

In some other embodiments, the handle 20 is linked with the projection module 30 through an electromagnetic induction module or a limit switch module (not shown). When the handle 20 is touched, the light-emitting unit 32 is driven to project the light beam. Consequently, the safe door opening range image is formed.

Figure 3:
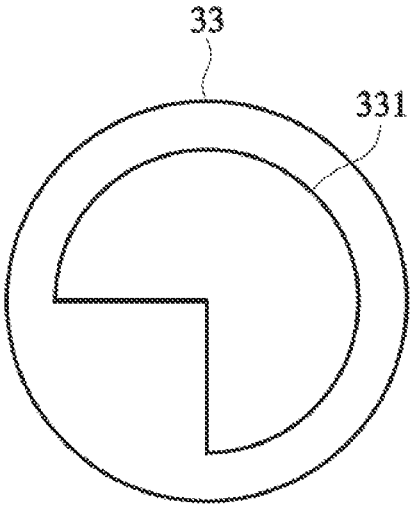
FIG. 3 schematically illustrates an example of the optical cover of the smart door lock device according to the first embodiment of the present invention.

Please refer to FIG. 3. FIG. 3 schematically illustrates an example of the optical cover of the smart door lock device according to the first embodiment of the present invention. As shown in FIG. 3, the light-transmissible part 331 of the optical cover 33 has a shape of a three-quarter circle. The size of the light-transmissible part 331 is determined according to the width of the door panel d. In other words, the user can select or replace a suitable optical cover 33 according to the width of the door panel d, and thus the size of the safe door opening range image is correspondingly adjusted.

In the above embodiment, the shape of the light-transmissible part 331 of the optical cover 33 has a fixed shape. It is noted that the shape of the light-transmissible part 331 is not restricted. For example, in another embodiment, the light-transmissible part 331 of the optical cover 33 is a liquid crystal display. The image shown on the liquid crystal display may be adjusted by the user according to the width of the door panel d or the user's requirement. Consequently, plural light-transmissible patterns with various sizes or shapes can be formed on the same optical cover 33.

Figure 4:
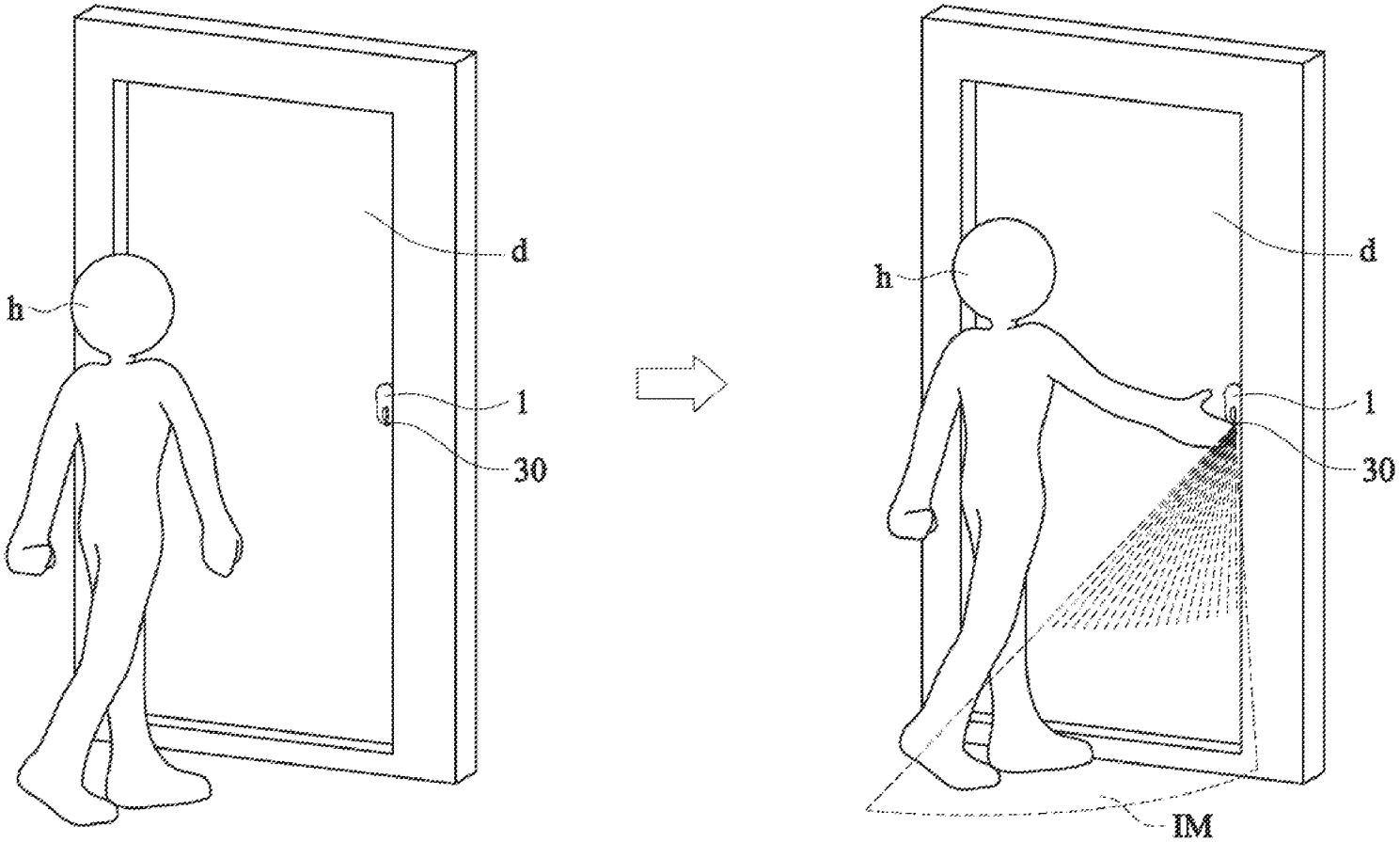
FIG. 4 schematically illustrates a scenario of operating the smart door lock device according to the first embodiment of the present invention.

Please refer to FIG. 4. FIG. 4 schematically illustrates a scenario of operating the smart door lock device according to the first embodiment of the present invention. Before the door panel d is opened by the user h, the smart door lock device 1 is not enable. When the user h intends to open the door panel d and the hand of the user h touches the handle 20 (see FIG. 2A) of the smart door lock device 1, the handle 20 drives the light-emitting unit 32 of the projection module 30 to project the light beam. After the light beam from the light-emitting unit 32 is transmitted through the light-transmissible part 331, a safe door opening range image IM corresponding to the rotation range of the door panel d is formed on the ground. According to the safe door opening range image IM on the ground, the user h can realize the rotation range of the door panel d. Consequently, the body or limbs of the user h will not be injured by the door panel d. Moreover, the safe door opening range image IM can prompt the user h of whether there is any obstacle in the rotation range of the door panel d. After the obstacle is removed, the door panel d can be opened smoothly.

Figure 5A:
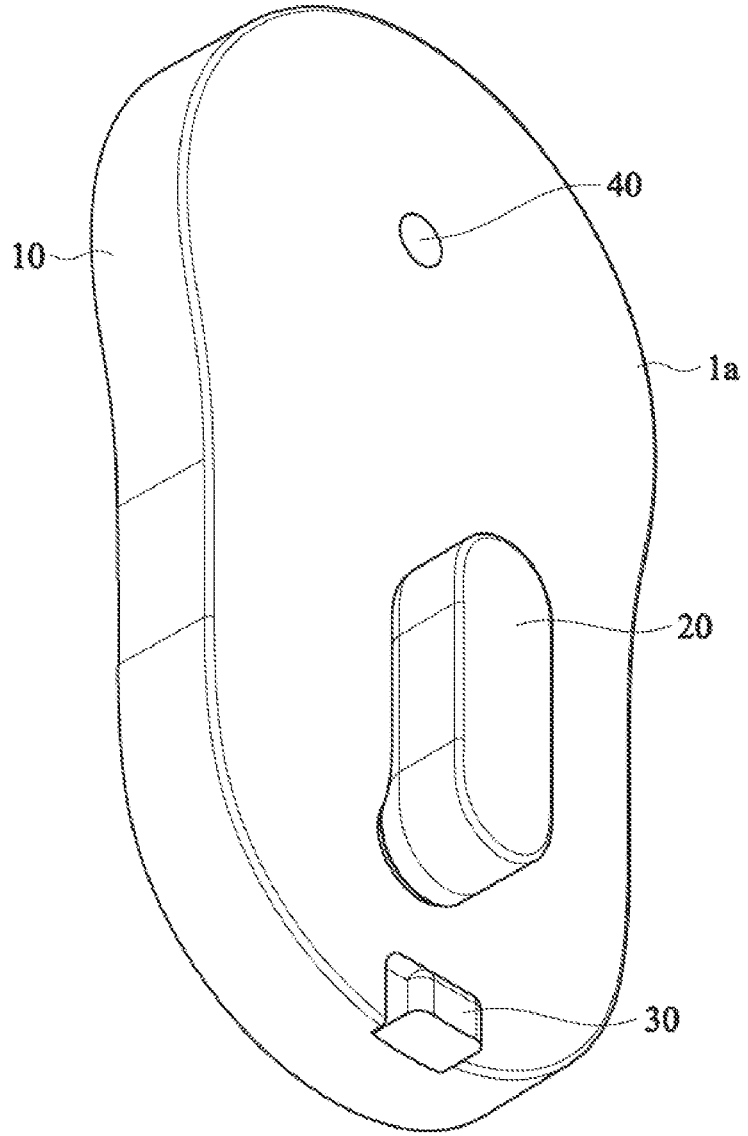
FIG. 5A is a schematic perspective view illustrating a smart door lock device according to a second embodiment of the present invention.

Please refer to FIG. 5A. FIG. 5A is a schematic perspective view illustrating a smart door lock device according to a second embodiment of the present invention. In this embodiment, the smart door lock device 1*a* also comprises a base 10, a handle 20 and a projection module 30. The base 10, the handle 20 and the projection module 30 of in the smart door lock device 1*a* of this embodiment are similar to those of the smart door lock device as shown in FIG. 2A, and not redundantly described herein. In comparation with the smart door lock 1 as shown in FIG. 2, the smart door lock 1*a* of this embodiment further comprises a distance sensing unit 40. The distance sensing unit 40 is installed on the base 10 and located over the handle 20. Moreover, the distance sensing unit 40 is electrically connected with the projection module 30 and linked with the projection module 30. For example, the distance sensing unit 40 is an ultrasonic sensing unit, a laser sensing unit, an infrared sensing unit or an image sensing unit. In this embodiment, the distance sensing unit 40 is located over the handle 20. It is noted that the installation position of the distance sensing unit 40 is not restricted. For example, the distance sensing unit 40 can be installed on any position of the base 10. In some embodiments, the distance sensing unit 40 is installed on the handle 20 or the door panel d (see FIG. 1).

Figure 5B:
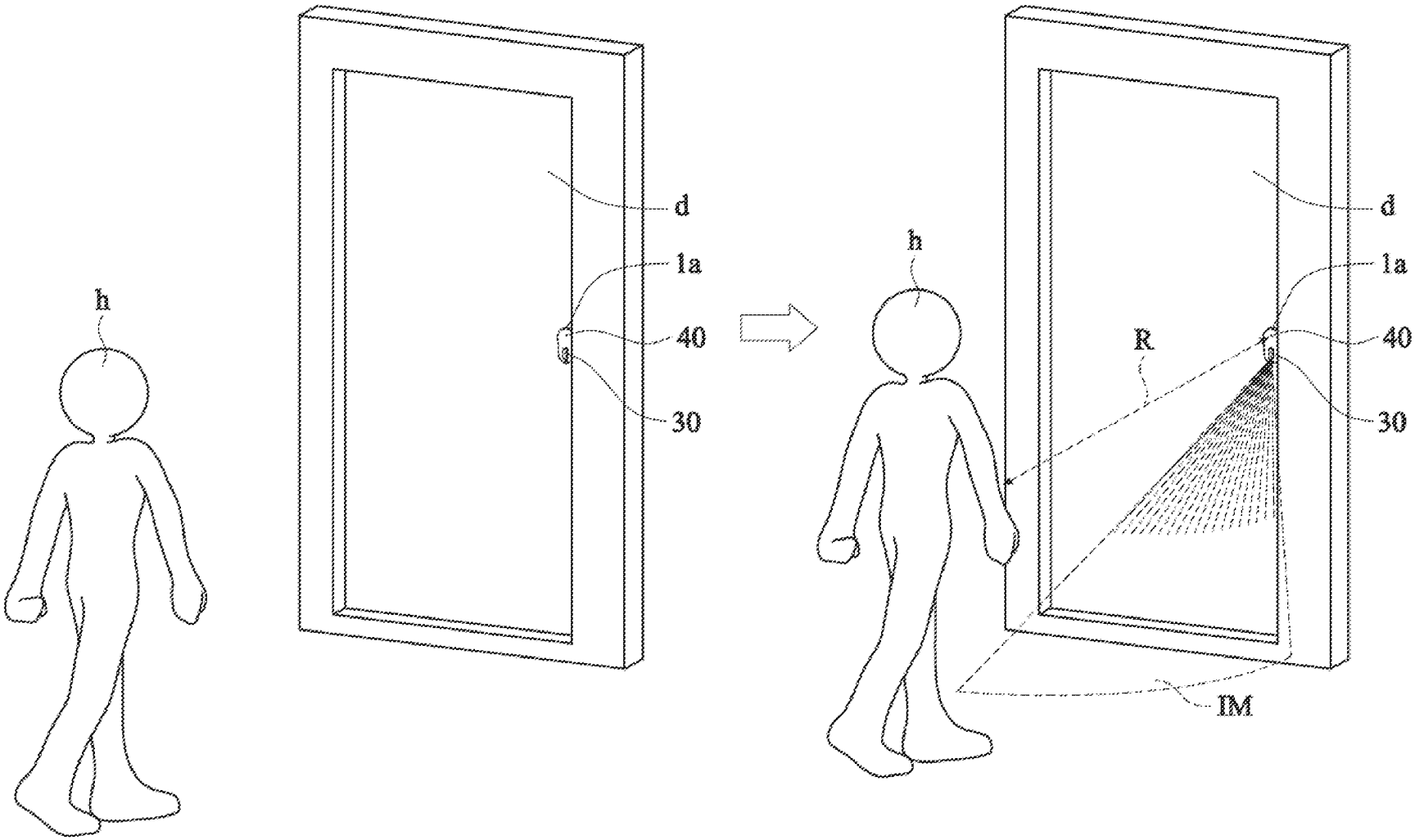
FIG. 5B schematically illustrates a scenario of operating the smart door lock device according to the second embodiment of the present invention.

Please refer to FIGS. 5A and 5B. FIG. 5B schematically illustrates a scenario of operating the smart door lock device according to the second embodiment of the present invention. When the user h approaches the door panel d and the distance between the user h and the door panel d detected by the distance sensing unit 40 of the smart door lock device 1*a* is smaller than or equal to a predetermined distance R, the distance sensing unit 40 drives the projection module 30 to project a light beam. Consequently, a safe door opening range image IM covering or corresponding to the rotation range of the door panel d is formed on the ground.

From the above descriptions, the present invention provides a smart door lock device. When the user intends to open the door panel, the user can realize the rotation range of the door panel according to the safe door opening range image on the ground. Consequently, the body or limbs of the user will not be injured by the door panel. Moreover, the safe door opening range image can prompt the user of whether there is any obstacle in the rotation range of the door panel. After the obstacle is removed, the door panel can be opened smoothly. In other words, the smart door lock device of the present invention is industrially valuable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A smart door lock device installed on a door panel, the smart door lock device comprising:

a base combined with the door panel;

a handle installed on the base; and a projection module comprising a lamp holder, a light-emitting unit and an optical cover, wherein the lamp holder is combined with the base, the lamp holder comprises a light projection surface, and the light projection surface has a mounting hole, wherein the light-emitting unit is disposed within the lamp holder and aligned with the mounting hole, wherein the optical cover is installed in the mounting hole, the light-emitting unit is covered by the optical cover, and the optical cover comprises at least one light-transmissible part, wherein after the light-emitting unit projects a light beam to the at least one light-transmissible part, the light beam is transmitted through the at least one light-transmissible part, so that a safe door opening range image corresponding to a rotation range of the door panel is formed on a ground.

2. The smart door lock device according to claim 1, wherein each of the at least one light-transmissible part has a shape of a three-quarter circle.

3. The smart door lock device according to claim 1, wherein the light-emitting unit is a light emitting diode unit, an organic light emitting diode unit, a quantum dot light emitting diode unit or an electroluminescent unit.

4. The smart door lock device according to claim 1, wherein the handle is linked with the projection module, wherein when the user touches the handle, the handle drives the light-emitting unit to project the light beam.

5. The smart door lock device according to claim 1, wherein the smart door lock further comprises at least one distance sensing unit, and the at least one distance sensing unit is installed on the base and linked with the projection module, wherein when a user approaches the door panel, the distance sensing unit drives the light-emitting unit to project the light beam.

6. The smart door lock device according to claim 5, wherein each of at least one the distance sensing unit is an ultrasonic sensing unit, a laser sensing unit, an infrared sensing unit or an image sensing unit.

* * * * *